United States Patent [19]

Sunaga et al.

[11] Patent Number: 4,726,211

[45] Date of Patent: Feb. 23, 1988

[54] METHOD OF COLD DRAWING SEAMLESS METAL TUBES EACH HAVING AN UPSET PORTION ON EACH END

[75] Inventors: Yutaka Sunaga, Kawasaki; Toshio Sakurai, Yokohama, both of Japan

[73] Assignee: Sanwa Kokan Kabushiki Kaishas, Yokohoma, Japan

[21] Appl. No.: 858,179

[22] Filed: May 1, 1986

Related U.S. Application Data

[62] Division of Ser. No. 599,825, Apr. 13, 1984, Pat. No. 4,606,212.

[51] Int. Cl.[4] ..... B21C 1/24

[52] U.S. Cl. ..... 72/283; 72/285; 72/276

[58] Field of Search ..... 72/283, 285, 291, 276, 72/260, 265

[56] References Cited

U.S. PATENT DOCUMENTS

| | | | |
|---|---|---|---|
| 295,898 | 4/1884 | Billings | 72/291 |
| 565,726 | 8/1896 | De Los Rice | 72/276 |
| 600,014 | 3/1898 | McCool | 72/283 |
| 2,240,456 | 4/1941 | Darner | 72/276 |

FOREIGN PATENT DOCUMENTS

| | | | |
|---|---|---|---|
| 129875 | 4/1902 | Fed. Rep. of Germany | 72/276 |
| 2448283 | 6/1975 | Fed. Rep. of Germany | 72/283 |
| 3016135 | 10/1981 | Fed. Rep. of Germany | 276/ |
| 716815 | 12/1931 | France | 72/283 |
| 2326993 | 5/1977 | France | 276/ |
| 31426 | 2/1982 | Japan | 72/283 |
| 99429 | 10/1961 | Netherlands | 72/283 |
| 606306 | 8/1948 | United Kingdom | 72/276 |

*Primary Examiner*—Daniel C. Crane

[57] ABSTRACT

A method of cold drawing seamless metal tubes each having an upset portion on each end. A draw bench used for carrying out the method of this invention comprises a die control device, a plug control device including a plug having large and small diameter bearing portions and a draw unit. The die control device and the plug control device are movable with each other for changing a cross sectional reducing area between the reducing die and the plug. The method is characterized in that the cross sectional reducing area between the reducing die and the plug is preferably changed in accordance with the desired forms of a mother tube to be drawn by longitudinally transferring the reducing die and the plug and fixing them at the selected positions.

2 Claims, 18 Drawing Figures

METHOD OF COLD DRAWING SEAMLESS METAL TUBES EACH HAVING AN UPSET PORTION ON EACH END

CROSS REFERENCE TO A RELATED APPLICATION

This application is a divisional application of U.S. application Ser. No. 599,825, filed Apr. 13, 1984, now U.S. Pat. No. 4,606,212 issued Aug. 19, 1986.

BACKGROUND OF THE INVENTION

1. Field of the Invention

The present invention relates to a method of cold drawing seamless metal tubes each having an upset portion on each end.

These seamless metal tubes are preferably used for drilling tubes, casings, inner rods and outer rods for geological, mineralogical, metallurgical or geothermal research and/or drilling for civil engineering or water wells.

2. Prior Art

With reference to FIGS. 1 to 4(*b*) showing the seamless metal tubes which have been produced by the conventional method using the conventional draw bench, a fot forged thin wall midbody *7c* of a metal tube is welded at each end with a thick wall end tube *7b* in order to obtain a large diameter seamless metal tube or pipe 7 having an upset portion *7b* on each end.

Alternatively, the seamless metal tube may be produced by casting or lathing, but metallic filaments in such a seamless metal tube are axially cut at welded or lathed portions or at blowholes, which are likely to cause cracks in the seamless metal tube after heat treatment at high temperature.

Thus, a method of and a draw bench for cold drawing seamless metal tubes each having an upset portion on each end have been proposed. For example, a small diameter and thin wall seamless metal tube having a diameter of 25–35 mm and a wall thickness of 2.1–3.2 mm, such as for a bicycle framework, may be cold drawn through the draw bench shown in FIGS. 2(*a*) to 4(*b*).

The conventional draw bench, which is particularly shown in FIGS. 2(*a*) and 2(*b*), for drawing such seamless metal tube comprises a bed 12 to be fixed on the floor, a die holder 26 which is mounted at a middle portion on the bed 12, and a closed periphery reducing die 2 which is concentrically mounted in the die holder 26. A pair of tongs 6 and a bearing are arranged on the entry side of the bed 12 for horizontally supporting a plug fixing rod 88.

Secured to a front portion of the rod 88 is a plug 4 which is inserted into the reducing die 2 when drawing.

A draw unit 110 is arranged on the exit side of the bed 12 and comprises a carriage 112 mounted on rollers travelling on the bed 12, the carriage 112 carrying a hook 118 and a chuck 114 for gripping the front tip *7a* of the mother tube or workpiece 7. The carriage 112 is driven by an endless chain 120 encompassing a driven sprocket wheel (not shown) mounted on the bed 12. A driving sprocket wheel is coupled by any convenient means with an electric motor (not shown). The hook 118 is engaged with the endless chain 120 when drawing, and the front tip *7a* of the mother tube 7 engaged by jaws 116 of the chuck 114 is strongly pulled by the carriage 122 to draw a tube 7 having an upset portion *7b* on each end.

The embodiments in FIGS. 3(*a*) and 3(*b*) show the conventional manner of drawing seamless metal tubes which have the same outer diameter but unequal inner diameter upset portions on both ends. In FIG. 3(*a*), a plug 4 is held adjacent to a tapered entry in the axial bore of the reducing die 2, at a clearance from the inner periphery of the mother tube 7, to draw the portion of the tube 7 having a small inner diameter upset portion *7b* on both ends, while the plug 4 in FIG. 3(*b*) is held right in the bore of the reducing die 2 to draw a tube 7 having a larger inner diameter.

FIGS. 4(*a*) and 4(*b*) show another conventional drawing method.

As shown in FIG. 4(*a*), a reducing die 2 can have an internal surface including an inlet portion *2b* which tapers forwardly toward a bearing or throat portion *2a*, and oppositely inclined outlet portion *2c*. When the enlarged front portion *4a* of a plug 4 is held right in the bearing portion *2a* of the reducing die 2, the mother tube 7 is drawn through the bearing portion *2a* and over the enlarged front portion *4a* to form a drawn tube having a small outer diameter.

In FIG. 4(*b*), the enlarged front portion *4a* of the plug 4 is passed leftwards through the bearing portion *2a* and located adjacent to the outlet portion *2c*. Then the mother tube 7 is drawn through the bearing portion *2a* and around the small diameter portion *4b* of the plug 4 to reduce the outer diameter of the drawn tube. When the mother tube 7 is further advanced, the inner diameter of the mother tube 7 is widened by the enlarged front portion *4a* of the plug 4 so as to draw a tube 7 having the same inner diameter as that of the enlarged front portion *4a* of the plug 4 and having an outer diameter upset portion *7b* larger than that of the drawn tube 7 produced by means of the reducing die 2 of FIG. 4(*a*).

Seamless metal tubes 7 drawn through conventional reducing dies 2 as described above have the following disadvantages:

(1) The seamless mother tube 7 having a small inner diameter is drawn through the reducing die 2 of FIG. 3(*a*) without any internal radial pressure, thus resulting in corrugation in and around the drawn tube.

(2) In FIG. 4(*b*), the mother tube 7 is drawn through the reducing die 2 with the plug 4 held in the bearing portion *2a* and in the tube 7 to obtain the drawn tube 7 having one outer diameter but two different inner diameter upset portions *7b*. The tube drawn through the bearing portion *2a* and over and around the small diameter portion *4a* of the plug 4 is widened by the enlarged front portion *4a* of the plug 4 to obtain a drawn tube similar to that shown in FIGS. 7(*a*), 7(*b*) and 7(*c*), wherein $d_4$ denotes a large diameter bearing portion of the plug 4, $d_2$ denotes a bearing portion diameter of the reducing die 2, $d_1$ denotes a large diameter of the drawn tube 7, and $d_3$ denotes a small diameter bearing portion of the plug 4 respectively.

Accordingly, $d_4$ becomes an inner diameter of the drawn tube 7 and $d_2$ becomes a small outer diameter of the drawn tube 7, but the large diameter $d_1$ of the drawn tube 7 is not directly related to the bearing portion diameters of the reducing die 2 and the plug 4, but is given by the following functional formula:

$$d_1 = f(d_2, d_3, d_4)$$

However, we cannot determine the values of $d_1$, $d_2$ and $d_4$ independently. In order to arrive at the most preferable values for $d_1$, $d_2$ and $d_4$, it is necessary to select the values sufficiently near the most suitable value among the various solutions of the functional formula of $$d_1 = f(d_2, d_3, d_4)$$

We cannot, however, obtain the most suitable values for the diamteers of $d_1$, $d_2$ and $d_4$.

(3) The configuration of the drawn tube is limited to only two kinds, i.e.

(a) one having one outer diameter but two unequal inner diameters;

(b) another having one inner diameter but two unequal outer diameters.

(4) The drawing force of the plug 4 is so small that the plug 4 may be driven in its movement by a hydraulic cylinder, while on the other hand it is necessary to provide a balancing unit or a plurality of hydraulic cylinders to balance the reaction upon the strong drawing force of the plug 4, thus making the device complicated and expensive.

SUMMARY AND OBJECTS OF THE INVENTION

A principal object of this invention is to provide a novel and improved method of cold drawing a seamless metal tube having an upset portion on each end.

Another object of this invention is to provide a novel and improved method of cold drawing a seamless metal tube wherein a reducing area between a reducing die and a plug is radially changed to draw a seamless metal tube having an upset portion on each end.

Another object of this invention is to provide a method of cold drawing a seamless metal tube wherein the drawing action is sufficiently reliable and reproducible to insure that each and every mother tube is ready to undergo drawing under reduction for forming unequal diameter upset portions on both ends.

Another object of this invention is to provide a method of cold drawing seamless metal tube whereby a reducing die and a plug having unequal diameter bearing portions are movable with each other and are fixed at the selected positions in order to draw a seamless metal tube having an upset portion on each end.

Another object of this invention is to provide a method of cold drawing seamless metal tube having an upset portion on each end whereby the reducing die and the plug are longitudinally movable to a number of different positions but remain at a standstill once they assume the selected positions to obtain a plurality of reducing area between the reducing die and the plug.

Another object of this invention is to provide a method of cold drawing a seamless metal tube having an upset portion on each end without forging, casting or welding.

Another object of this invention is to provide a method of cold drawing a seamless metal tube having an upset portion on each end which has no alteration in the structure, in strength of the upset end portion and of the midbody of the drawn tube, but has dimensional stability in all areas thereof.

Another object of this invention is to provide a method of cold drawing a seamless metal tube having an upset portion on each end which has no scales, but has tighter tolerance, thus enabling the tubes to be thread without prior machining.

Still another object of this invention is to provide a method of cold drawing a seamless metal tube having an upset portion on each end whereby precise threading can be achieved and threading efficiently can be remarkably improved.

BRIEF DESCRIPTION OF DRAWING

The nature of this invention will be clear from the following detailed description of particular embodiments of the proposed method of cold drawing a seamless metal tube having an upset portion on each end when taken with the accompanying drawings, in which:

FIG. 2(*b*) is an enlarged detailed vertical sectional view of a reducing die, a plug and a mother tube shown in FIG. 2(*a*), particularly showing that the mother tube is being drawn through the reducing die and around the plug;

FIG. 5(*b*) is a greatly enlarged detailed vertical sectional view of the die control device of the draw bench shown in FIG. 5(*a*);

FIG. 5(*c*) is a greatly enlarged detailed vertical sectional view of a hydraulic cylinder which is secured to a rear face of the die holder shown in FIGS. 5(*a*) and 5(*b*);

FIG. 7(*b*) is an enlarged vertical section similar to FIG. 7(*a*), with the large diamater bearing of the plug located at the small diameter bearing portion of the reducing die;

FIG. 7(*c*) is also an enlarged vertical section similar to FIG. 7(*a*), with the large diameter bearing of the plug located at the forwardly tapered outlet portion;

FIG. 8(*b*) is a similar cross section of a seamless metal tube drawn by the method of this invention, and having an inner upset portion on one end and an outer upset portion on another end;

FIG. 8(*c*) is a similar cross section of a seamless metal tube drawn through the method of this invention, and having an outer upset portion on each end.

DETAILED DESCRIPTION OF THE PREFERRED EMBODIMENT

The method of this invention is characterized in that the cross-sectional reducing area between the reducing die and the plug is preferably changed in accordance with the desired forms of a mother tube to be drawn by longitudinally transferring the reducing die and the plug and fixing them at the selected positions.

Figure 1:
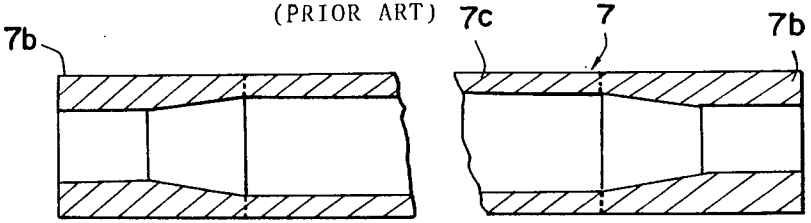
FIG. 1 (PRIOR ART)
FIG. 1 is a cross section of a seamless metal tube made by a conventional process such as by casting, lathing or hot forging, with its midbody partially cut away.
Figure 2:
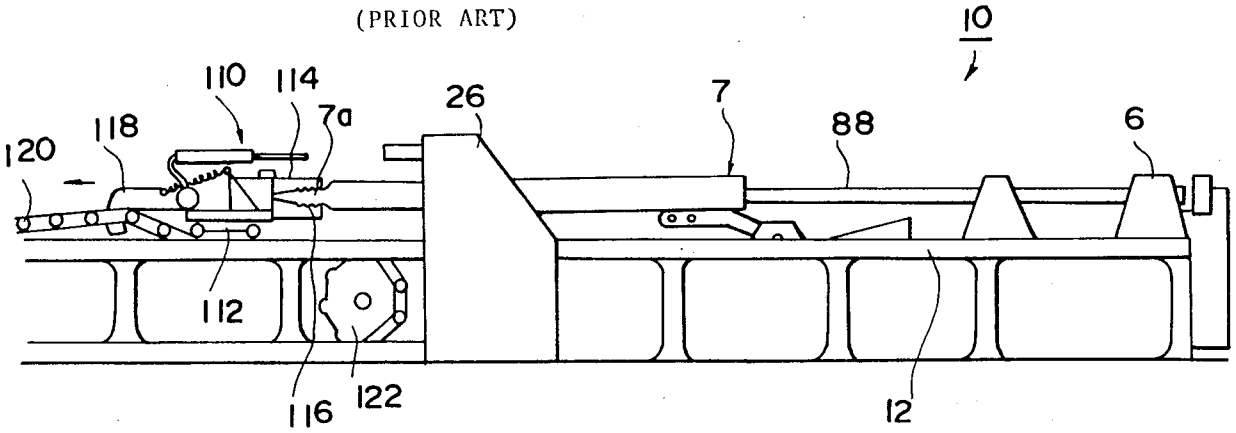
FIG. 2 (a) (PRIOR ART)
FIG. 2(*a*) is a side elevation of a conventional draw bench, with the chain drive portion of a draw unit partially cut away.
Figure 2:
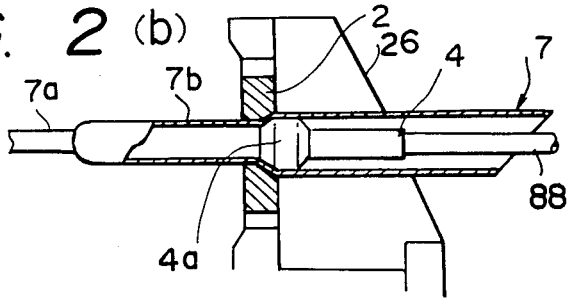
FIG. 2 (b) (PRIOR ART)
Figure 3:
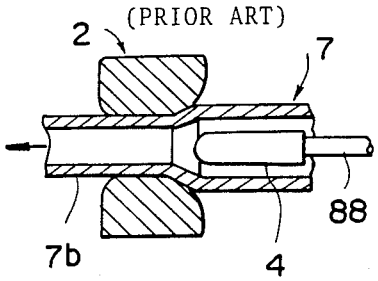
FIG. 3 (a) (PRIOR ART)
FIGS. 3(*a*) and 3(*b*) are fragmentary axial sectional views of the reducing die and the modified plug showing some conventional drawing steps for drawing seamless metal tubes.
Figure 3:
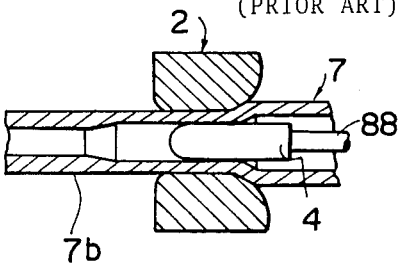
FIG. 3 (b) (PRIOR ART)
Figure 4:
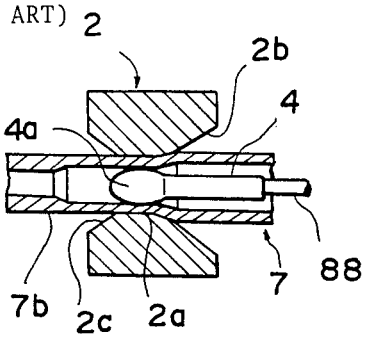
FIG. 4 (a) (PRIOR ART)
FIGS. 4(*a*) and 4(*b*) are similar fragmentary axial sectional views of the reducing die and the modified plug, showing other conventional drawing steps for drawing ordinary seamless metal tubes.
Figure 4:
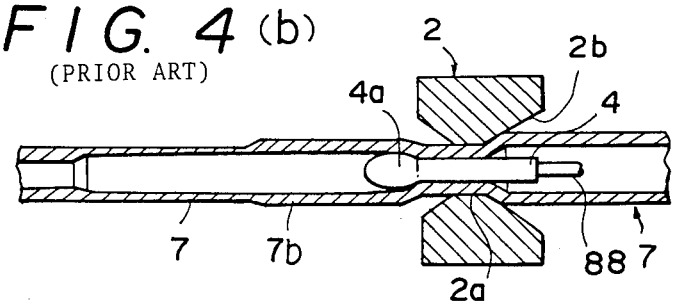
FIG. 4 (b) (PRIOR ART)
Figure 5:
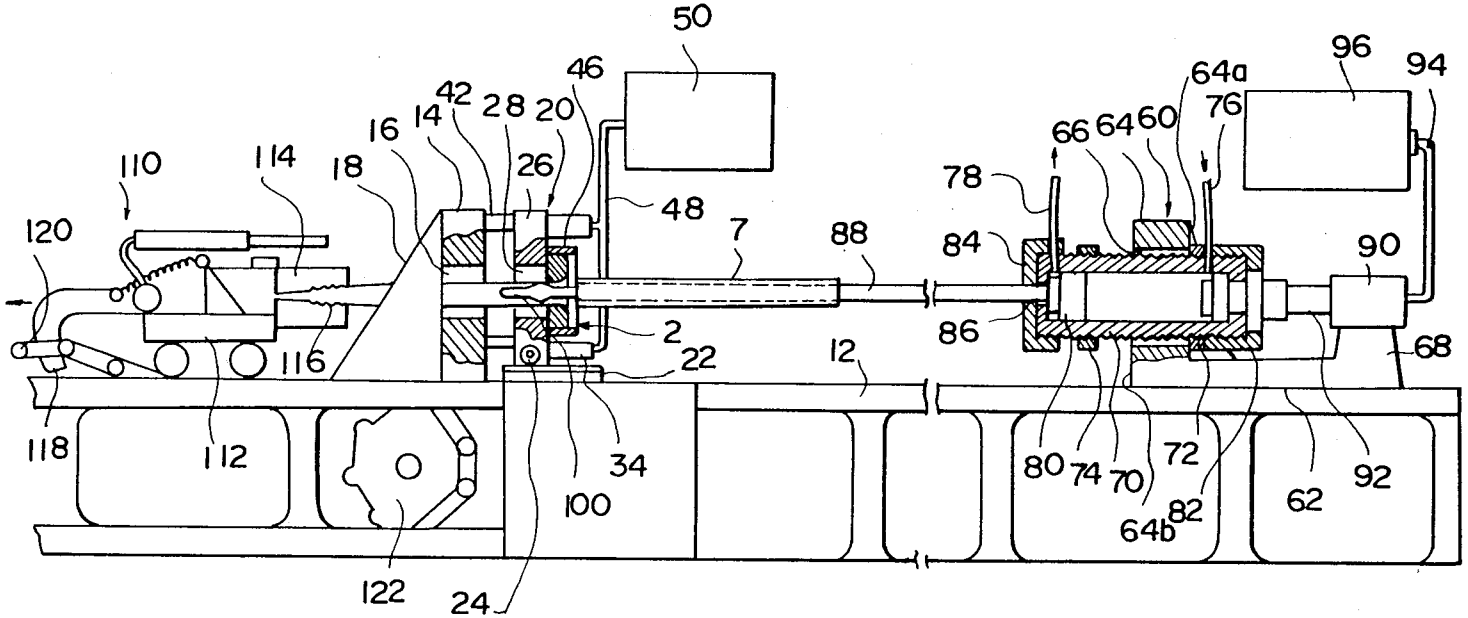
FIG. 5(*a*) is a side elevation, partly in section, of a draw bench which is used for carrying out the method of this invention.
Figure 5:
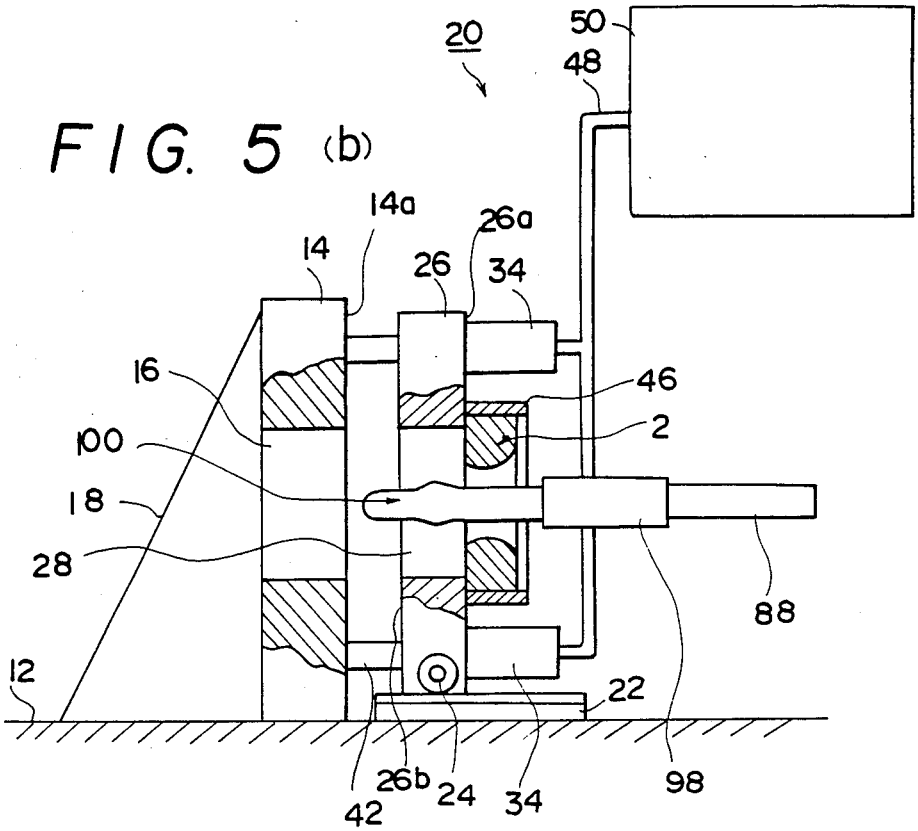
Figure 5:
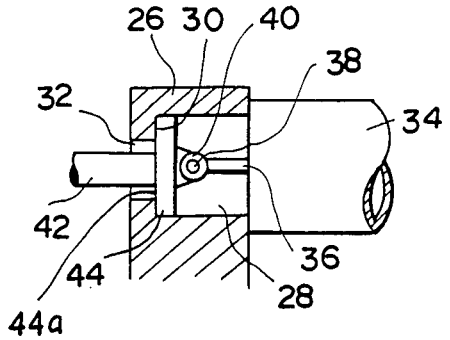

Proceeding now with a detailed description of the drawings, we turn first to FIGS. 5(*a*) through 6 illustrating this invention. A draw bench 10 for carrying out the method of this invention comprises a bed 12 which is usually fixed on the floor, a front stopper 14 which is mounted at the middle portion on the bed 12 and is reinforced by a reinforcing member 18, the stopper 14 having a central large opening 16.

In FIGS. 5(*a*) and 5(*b*), a die control device 20, which is arranged on the bed 12 adjacent to the front stopper 14, includes a rail 22 extending longitudinally on the bed 12, and a carriage 24 arranged movably on the rail 22. A die holder 26 rigidly secured on the carriage 24 has a large diameter central opening 28, and a cylindrical holder 46 including a closed periphery reducing die 2 is secured to a rear face of the die holder 26 in line with the central large diameter opening 28 thereof.

A pair of hydraulic cylinders 34 extend in the axial direction at diametrically opposite peripheral regions of the rear face of the die holder 26, one end portion of each of the hydraulic cylinders penetrating through the die holder 26 and being connected to the rear face of the front stopper 14 by means of a ram 42.

As particularly shown in FIG. 5(*c*), a pair of axially extending cylindrical recesses 28 are formed in the rear face of the die holder 26 near its outer periphery, and a small opening 32 is formed through the floor 30 of each cavity 28. A large diameter flange 44 of a respective one of the rams 42 is inserted into each recess 28, the ram extending through the small opening 32 being connected to the rear of the front stopper 14.

The front end of the piston 36 of the hydraulic cylinder 34 is coupled to a male lug 40 which is provided at a central rear face of the large diameter flange 44, and the front end of the hydraulic cylinder 34 is secured to the rear face of the die holder 26 to abut upon the hollow portion 28 thereof.

In this way, the front face 44*a* of the large diameter flange 44 provided at the end of the ram 42 is brought into contact with the innermost portion 30 of the cylindrical hollow portion 28 when the piston (not shown) within the hydraulic cylinder 34 is advanced forwardly.

The hydraulic cylinder 34 produces a pushing force which is larger than a tube drawing force of for instance 150–200 tons. In order to fix the die holder 26 at the desired position, the large diameter flange 44 is preferably brought into contact with the innermost portion 30. The hydraulic cylinders 34 are connected to a hydraulic unit 50 by a pipe 48.

Figure 6:
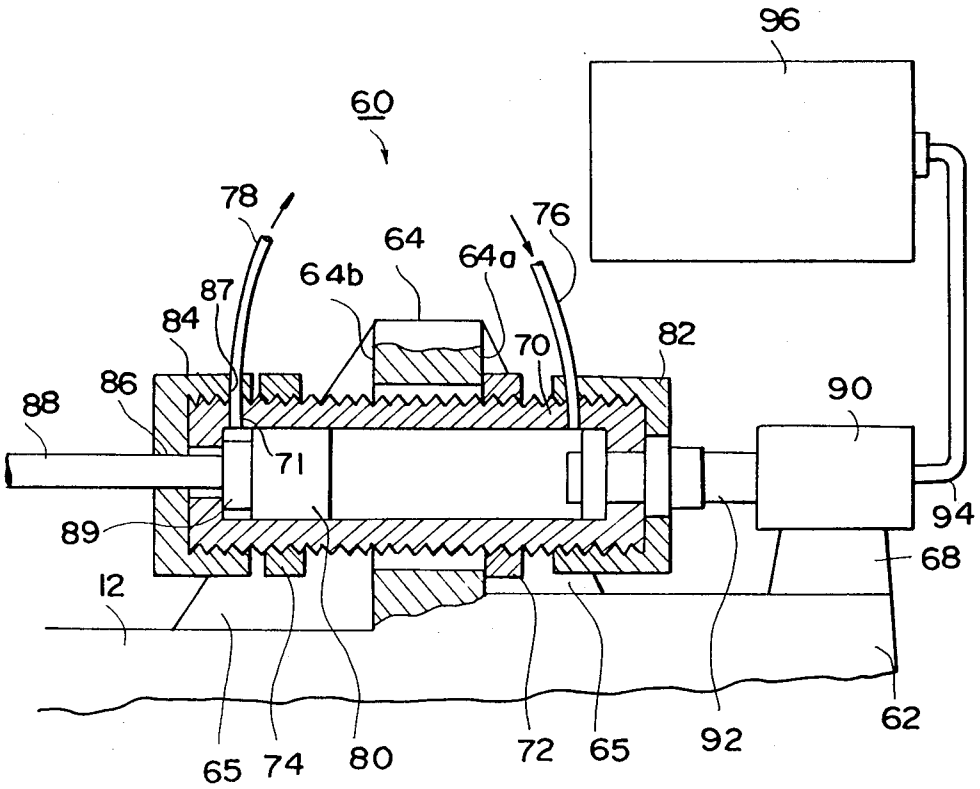
FIG. 6 is a greatly enlarged detailed vertical sectional view of the plug control device.

A plug control device 60 shown in FIG. 6 is arranged on the bed 12 at the entry side thereof and coaxially with the die control device 20. The plug control device 60 includes a base 62 which is rigidly mounted on the bed 12, a rear stopper 64 having a central lateral opening 66, and a rear post 68, the rear stopper 64 being reinforced on both sides by a pair of reinforcing members 65.

A leading screw compressed-air cylinder 70 having a radial small opening 71 through a periphery rotatably and slidably extends through the central lateral opening 66, and a pair of screw nuts 72 and 74 are threadedly screwed on the extending portions of the compressed-air cylinder 70.

A rear end cover 82 including a compressed-air supply flexible pipe 76 is threadedly screwed on the rear end of the cylinder 70, and front cover 84 having a central opening 86 and a radial small opening 87 is threadedly screwed on the front portion of the cylinder 70. Prior to screwing of the front cover 84, a rear portion of a push-pull main rod 88 is closely fitted through the central opening 86 of the front cover 84 to allow a large diameter flange 89 to be located within the hollow cylinder 70 when the cover 84 is screwed on the front end of the cylinder 70. When cover 84 is screwed on cylinder 70, the small radial opening 71 of the cylinder 70 is coincided with the radial small opening 87, into which a compressed-air exhaust flexible pipe 78 is connected. The large diameter flange 89 of the push-pull main rod 88 is connected to the piston 80 within the cylinder 70.

A front portion of a hydraulic cylinder 90 which is laterally mounted on the rear post 68 is coupled to the rear end of the cylinder 70 by a ram 92, the rear end of which is connected to a hydraulic unit 96 by a pipe 94.

Figure 7:
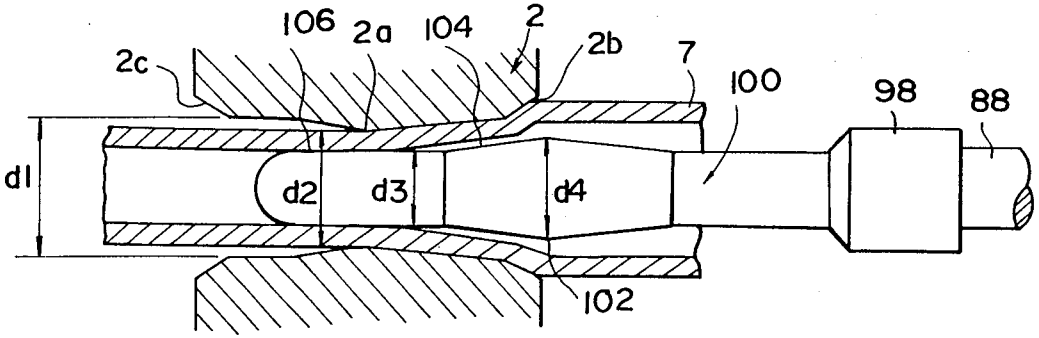
FIG. 7(*a*) is an enlarged vertical section of the reducing die, the mother tube and the plug of this invention, with its large diameter bearing of the plug approaching an inlet portion of the reducing die.
Figure 7:
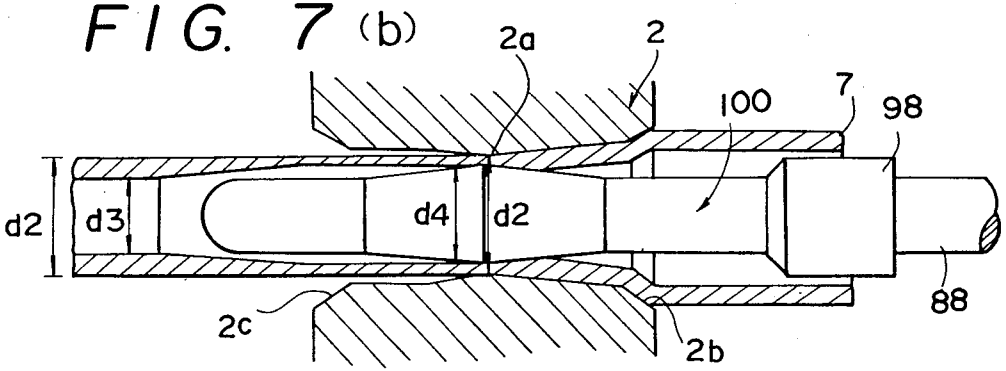
Figure 7:
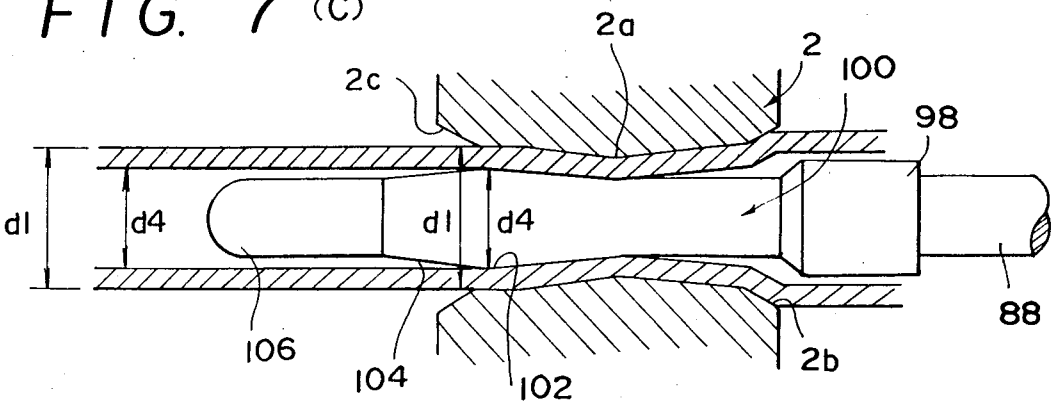

As shown in FIGS. 7(*a*) to 7(*c*), a plug 100 is secured to a front end portion of the push-pull main rod 88 by a shank 98, and the plug 100 includes a large diameter bearing portion 102 ($d_4$), a forwardly tapered portion 104 and a small diameter bearing portion 106 ($d_3$) which are shaped forwardly in the stated order.

In accordance with the draw bench 10 of this invention, the left screw nut 74 is rotatably brought into contact with the front face 64*b* of the rear stopper 64 to determine the right fixed position, while the right screw nut 72 is rotatably brought into contact with the rear face 64*a* thereof to determine the left fixed position.

For drawing, the reducing die 2 and the plug 100 are respectively transferred to take the fixed positions by the hydraulic units 50 and 96 which are connected thereto by the respective pipes 48 and 94.

The reducing die 2 has an internal surface including an inlet portion 2*b* which tapers rearwardly, a small diameter bearing or throat portion 2*a* and an oppositely inclined outlet portion 2*c*.

A draw unit 110 is arranged on the exit side of the bed 12 and comprises a carriage 112 mounted on rollers travelling on the bed 12, the carriage 112 carrying a hook 118 and a chuck 114 for gripping the front tip 7*a* of the mother tube or workpiece 7. The carriage 112 is driven by an endless chain 120 encompassing a driven sprocket 122 and a driving sprocket wheel (not shown) mounted in the bed 12.

Drawing operations are schematically shown in FIGS. 7(*a*) to 7(*c*). The die holder 26 is located at the left fixed position as shown in FIG. 5(*a*) to locate the large diameter bearing portion 102 ($d_4$) of the plug 100 at the rearwardly tapered inlet portion 2*b* as shown in FIG. 7(*a*), while the plug control device 60 is located at the right fixed position in FIG. 6 for drawing the mother tube 7.

In FIG. 7(*b*), the die holder 26 is located at the left fixed position and the plug fixing main rod 88 is also located at the left fixed position to fix the large diameter bearing portion 102 ($d_4$) of the plug 100 at the throat portion 2a of the reducing die 2, thus drawing the mother tube 7 having an inner peripheral upset portion 7b on each end.

In FIG. 7(*c*), the die holder 26 and plug fixing main rod 88 are relatively located so that the large diameter bearing portion 102 is located at the outlet portion 2c so that the tube is drawn out with an outer diameter d*l* and an inner diameter d4.

Figure 8:
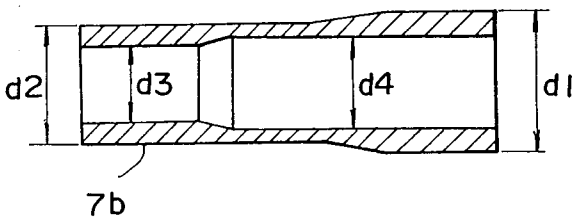
FIG. 8(*a*) is a cross section of a seamless metal tube drawn through the draw bench of this invention, and having an inner upset portion on each end.
Figure 8:
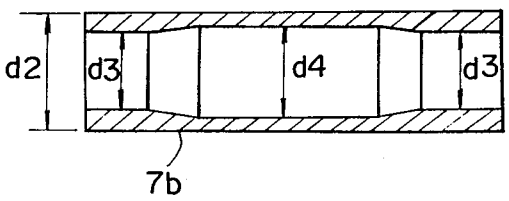
Figure 8:
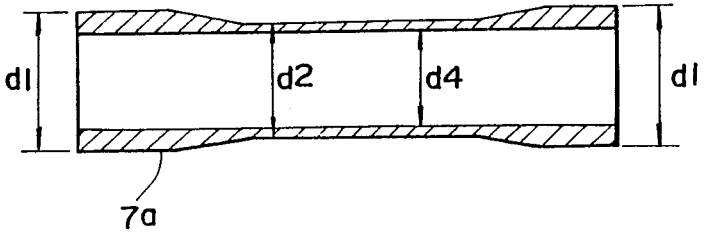
Figure 9:
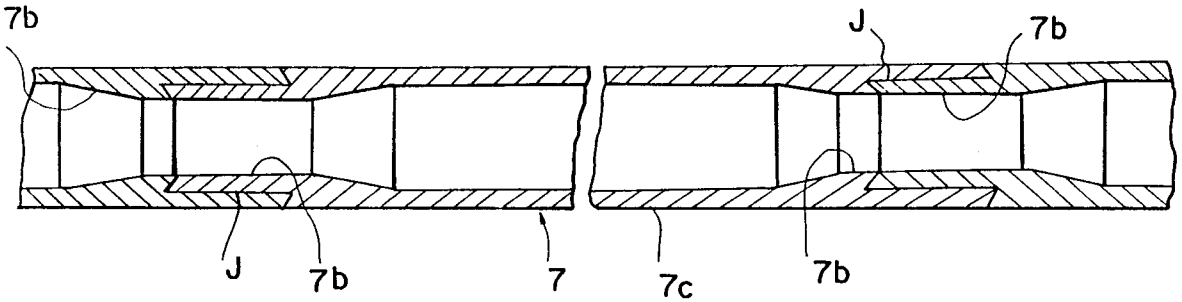
FIG. 9 is a cross section of the seamless metal tubes, partially cut away, which are screw-threadedly joined to each other through the upset portion on each end.

The drawn tube 7 having an inner peripheral upset portion 7b on one end and an outer peripheral upset portion 7b on another end shown in FIG. 8(*b*) can be obtained through the continuous successive steps shown in FIGS. 7(*a*), 7(*b*) and 7(*c*). The drawn tube 7 having an inner peripheral upset portion 7b on each end can be formed by successively performing the steps shown in FIGS. 7(*a*), 7(*b*) and 7(*a*).

Finally, the drawn tube having outer peripheral upset portions 7b on both ends shown in FIG. 8(*c*) can be formed by successively performing the steps shown in FIGS. 7(*c*), 7(*b*) and 7(*c*).

The die holder 26 and the plug fixing main rod 88 are driven to move with each other by means of the hydraulic units 50 and 96 which are mounted on the bed 12, taking account of the speeds among the drawn tube 7, the reducing die 2 and the plug 100.

After drawing, the plug 100 is again brought back to the starting position by the plug control device 60, while the die holder 26 is also returned to the starting position by the die control device 20.

An example of the drawn tube 7 having an upset portion 7b on each end embodying the novel feature of this invention is given below.

| | |
|---|---|
| Material | Mn—Cr—Mo steel alloy |
| Heat treatment | Quenching and tempering finally resulting in martensitic structure. |
| Size after drawing: | |
| Outer diameter | 88.0 mm |
| Thick wall thickness | 6.6 mm |
| Thin wall thickness | 5.0 mm |
| Length | 2–6 m |
| Shore hardness | 43 |
| Strength | 90 $Kg/mm^2$ |
| Joint of each drawn tube | Joined at acme tapered screw thread of the upset end portion. |
| Use | Surveying for underground resource such as uranium, metals, etc. or for geological surveying. |
| Rotation | 800–1000 rpm |
| Depth | Boring 1000–1500 m under the ground. |
| Other benefits | Mud and slurry are smoothly circulated. |

As is clear from the foregoing description and the example, the preferred drawing method in accordance with this invention considerably improves the drawing steps, drawing rate, reduction of area and the like, and may advantageously be used to draw seamless metal tubes having upset portions at both ends.

While an embodiment of this invention has been described, it is obvious that variations and modifications are possible without departing from the invention. It is desired to cover all such forms of the invention as would be apparent to one skilled in the art, and that come within the scope of the appended claims.

We claim:

1. A method of cold drawing a seamless metal tube having an upset portion on each end, comprising the steps of:

defining a reducing area between first and second relatively movable members, the first member being a closed periphery reducing die and the second member being a plug secured to a front end portion of a main push-pull rod, the reducing die having an internal surface including a rearward inlet portion which tapers rearwardly, a forward outlet portion which tapers forwardly, and a small diameter bearing portion between the inlet and outlet portions, the plug having a large diameter bearing portion between a rearward rearwardly tapered portion and a forward small diameter bearing portion;

moving the reducing die and the plug longitudinally with respect to each other at least twice to vary the size of the reducing area and fixing the reducing die and the plug in three different positions selected from first, second and third relative positions, the forward small diameter bearing portion of the plug being radially aligned with the small diameter bearing portion of the die in the first relative position so that the inner and outer peripheries of the reducing area therebetween respectively have a first inner diameter and a first outer diameter, the large diameter bearing portion of the plug being radially aligned with the small diameter bearing portion of the die in the second relative position so that the inner and outer peripheries of the reducing area therebetween respectively have a second inner diameter greater than the first inner diameter and a second outer diameter equal to said first outer diameter, and the large diameter bearing portion of the plug being radially aligned with the outlet portion of the die in the third relative position so that the inner and outer peripheries of the reducing area therebetween respectively have a third inner diameter equal to the second inner diameter and a third outer diameter greater than the first and second outer diameters; and successively drawing a mother tube through the die and around the plug through the reducing area in three steps, each of said steps being performed when the plug and die are in a different one of the first, second and third positions, to thereby successively form first, second and third tube portions having inner and outer diameters corresponding to the reducing area during each of the three steps, at least one of the first and third tube portions forming an upset portion with the second tube portion therebetween, two of the tube portions having different inner diameters and different outer diameters.

2. A method of cold drawing a seamless metal tube having an upset portion on each end, comprising the steps of:

defining a reducing area between first and second relatively movable members, the first member being a closed periphery reducing die and the second member being a plug secured to a front end portion of a main push-pull rod, the reducing die having an internal surface including a rearward inlet portion which tapers rearwardly, a forward outlet portion which tapers forwardly, and a small diameter bearing portion between the inlet and outlet portions, the plug having a large diameter bearing portion between a rearward rearwardly tapered portion and a forward small diameter bearing portion;

moving the reducing die and plug longitudinally with respect to each other at least twice to vary the size of the reducing area and fixing the reducing die and the plug in three different positions selected from first, second and third relative positions, the forward small diameter bearing portion of the plug being radially aligned with the small diameter bearing portion of the die in the first relative position so that the inner and outer peripheries of the reducing area therebetween respectively have a first inner diameter and a first outer diameter, the large diameter bearing portion of the plug being radially aligned with the small diameter bearing portion of the die in the second relative position so that the inner and outer peripheries of the reducing area therebetween respectively have a second inner diameter greater than the first inner diameter and a second outer diameter equal to said first outer diameter, and a large diameter bearing portion of the plug being radially aligned with the outlet portion of the die in the third relative position so that the inner and outer peripheries of the reducing area therebetween respectively have a third inner diameter equal to the second inner diameter and a third outer diameter greater than the first and second outer diameters; and successively drawing a mother tube through the die and around the plug through the reducing area in three steps, each of said steps being performed when the plug and die are fixed in a different one of the first, second and third positions, including the steps of relatively fixing the plug and die in one of the first and third relative positions during the first step, then relatively moving the plug and die to the second relative position and relatively fixing the plug and die in the second relative position during the second step, and then relatively moving the plug and die to the other of the first and third relative positions and relatively fixing the plug and die in said other of the first and third relative positions during the third step, to thereby successively form first, second and third tube portions having inner and outer diameters corresponding to the reducing area during each of the three steps, the first and third tube portions forming upset portions with the second tube portion therebetween, whereby there is formed a tube having an outer upset portion and an inner upset portion at the first and third tube portions at the respective opposite ends of the second tube portion.

* * * * *